US007781970B2

(12) United States Patent
Shim et al.

(10) Patent No.: US 7,781,970 B2
(45) Date of Patent: Aug. 24, 2010

(54) PLASMA DISPLAY PANEL

(75) Inventors: Jeongseob Shim, Gumi (KR); Soonhak Kim, Gumi (KR)

(73) Assignee: LG Electronics Inc., Seoul (KR)

( * ) Notice: Subject to any disclaimer, the term of this patent is extended or adjusted under 35 U.S.C. 154(b) by 31 days.

(21) Appl. No.: 12/357,863

(22) Filed: Jan. 22, 2009

(65) Prior Publication Data

US 2010/0033092 A1 Feb. 11, 2010

(30) Foreign Application Priority Data

Aug. 6, 2008 (KR) ..... 10-2008-0076850

(51) Int. Cl.
*H01J 17/49* (2006.01)

(52) U.S. Cl. ..... 313/582

(58) Field of Classification Search ..... 313/582, 313/584

See application file for complete search history.

(56) References Cited

U.S. PATENT DOCUMENTS

2004/0259452 A1* 12/2004 Matsumoto et al. ..... 445/24

* cited by examiner

*Primary Examiner*—Vip Patel
(74) *Attorney, Agent, or Firm*—Ked & Associates, LLP

(57) ABSTRACT

A plasma display panel is provided. The plasma display panel includes a front substrate, scan electrodes and sustain electrodes that are positioned on the front substrate substantially parallel to each other, a rear substrate opposite the front substrate, a barrier rib on the rear substrate, and a black layer opposite the barrier rib. The black layer is positioned on the front substrate substantially parallel to the scan electrode and the sustain electrode. The black layer includes a first black layer between two adjacent scan electrodes and a second black layer between two adjacent sustain electrodes. An auxiliary electrode is positioned on the second black layer.

20 Claims, 20 Drawing Sheets

PLASMA DISPLAY PANEL

This application claims the benefit of Korean Patent Application No. 10-2008-0076850 filed on Aug. 6, 2008, the entire contents of which is hereby incorporated by reference.

BACKGROUND

1. Field

Embodiments relate to a plasma display panel.

2. Description of the Background Art

A plasma display panel includes a phosphor layer inside discharge cells partitioned by barrier ribs and a plurality of electrodes.

When driving signals are applied to the electrodes of the plasma display panel, a discharge occurs inside the discharge cells. More specifically, when the discharge occurs in the discharge cells by applying the driving signals to the electrodes, a discharge gas filled in the discharge cells generates vacuum ultraviolet rays, which thereby cause phosphors between the barrier ribs to emit visible light. An image is displayed on the screen of the plasma display panel using the visible light.

SUMMARY

In one aspect, a plasma display panel comprises a front substrate, scan electrodes and sustain electrodes that are positioned on the front substrate substantially parallel to each other, a rear substrate opposite the front substrate, a barrier rib on the rear substrate, a black layer opposite the barrier rib, the black layer being positioned on the front substrate substantially parallel to the scan electrode and the sustain electrode, the black layer including a first black layer between the two adjacent scan electrodes and a second black layer between the two adjacent sustain electrodes, and an auxiliary electrode on the second black layer.

In another aspect, a plasma display panel comprises a front substrate, scan electrodes and sustain electrodes that are positioned on the front substrate substantially parallel to each other, a rear substrate opposite the front substrate, a barrier rib on the rear substrate, a black layer opposite the barrier rib, the black layer being positioned on the front substrate substantially parallel to the scan electrode and the sustain electrode, the black layer including a first black layer between the two adjacent scan electrodes and a second black layer between the two adjacent sustain electrodes, a width of the second black layer being greater than a width of the first black layer, and an auxiliary electrode on the second black layer.

In still another aspect, a plasma display panel comprises a front substrate, scan electrodes and sustain electrodes that are positioned on the front substrate substantially parallel to each other, the scan electrodes and the sustain electrodes being bus electrodes, a rear substrate opposite the front substrate, a barrier rib on the rear substrate, a black layer opposite the barrier rib, the black layer being positioned on the front substrate substantially parallel to the scan electrode and the sustain electrode, the black layer including a first black layer between the two adjacent scan electrodes and a second black layer between the two adjacent sustain electrodes, a width of the second black layer being greater than a width of the first black layer, and an auxiliary electrode on the second black layer.

BRIEF DESCRIPTION OF THE DRAWINGS

The accompany drawings, which are included to provide a further understanding of the invention and are incorporated on and constitute a part of this specification, illustrate embodiments of the invention and together with the description serve to explain the principles of the invention. In the drawings.

DETAILED DESCRIPTION

Reference will now be made in detail embodiments of the invention examples of which are illustrated in the accompanying drawings.

Figure 1:
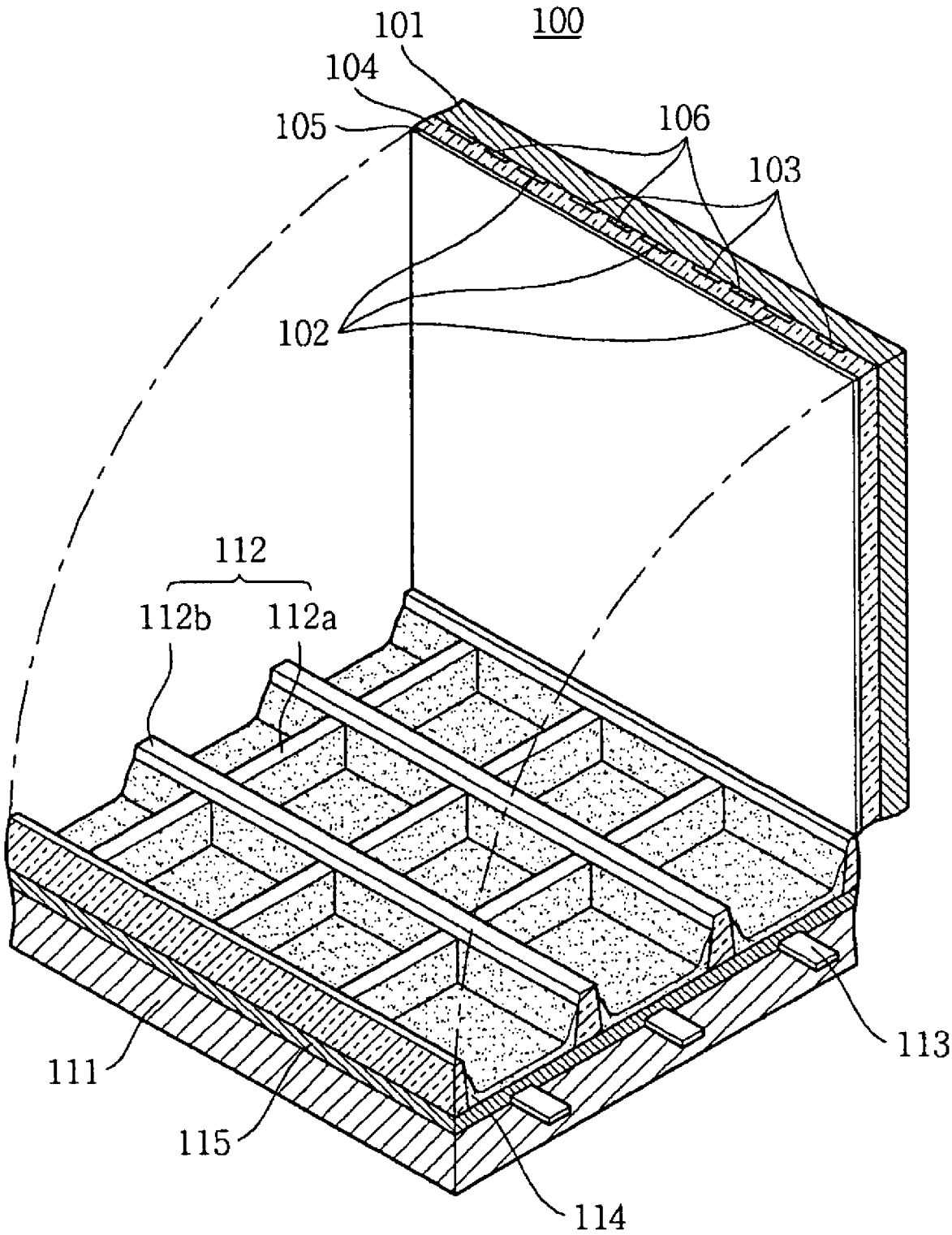
FIGS. 1 and 2 illustrate a structure of a plasma display panel according to an exemplary embodiment.
Figure 2:
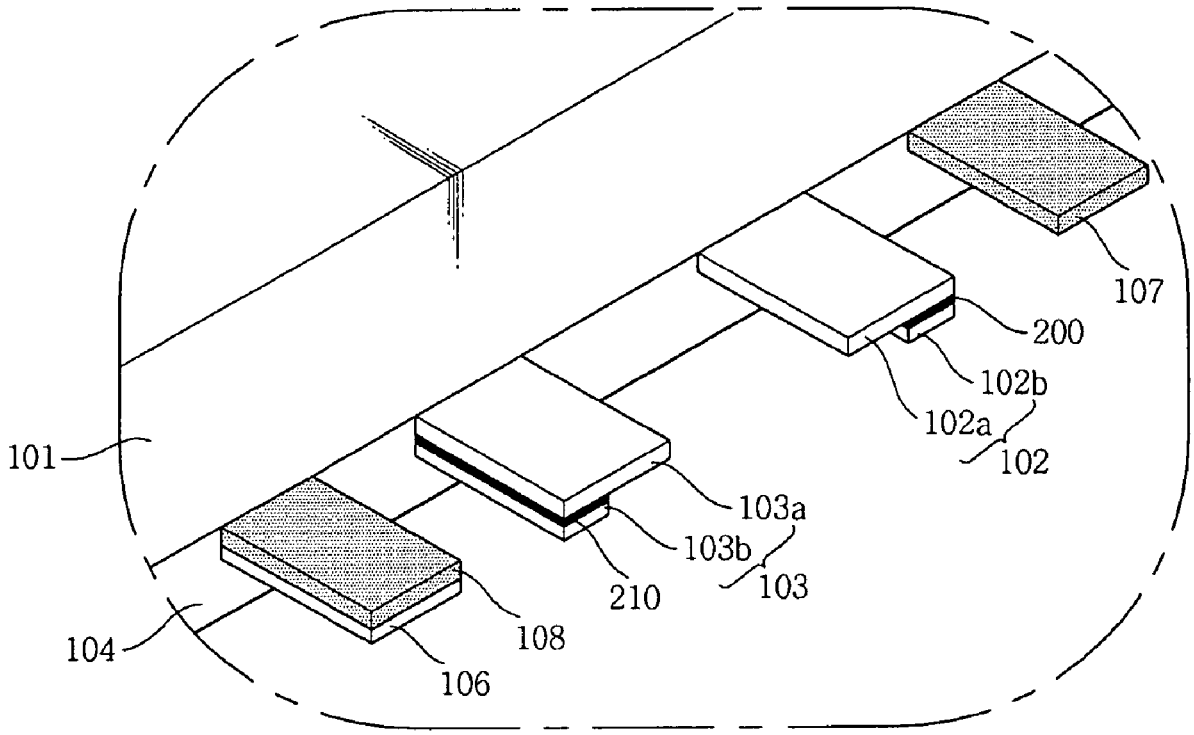

FIGS. 1 and 2 illustrate a structure of a plasma display panel according to an exemplary embodiment.

As shown in FIG. 1, a plasma display panel 100 may include a front substrate 101 on which a scan electrode 102 and a sustain electrode 103 are positioned substantially parallel to each other and a rear substrate 111 on which an address electrode 113 is positioned to cross the scan electrode 102 and the sustain electrode 103.

An upper dielectric layer 104 may be formed on the scan electrode 102 and the sustain electrode 103 to limit a discharge current of the scan electrode 102 and the sustain electrode 103 and to provide insulation between the scan electrode 102 and the sustain electrode 103.

A protective layer 105 may be formed on the upper dielectric layer 104 to facilitate discharge conditions. The protective layer 105 may be formed of a material having a high secondary electron emission coefficient, for example, magnesium oxide (MgO).

A lower dielectric layer 115 may be formed on the address electrode 113 to provide insulation between the address electrodes 113.

Barrier ribs 112 of a stripe type, a well type, a delta type, a honeycomb type, etc. may be formed on the lower dielectric layer 115 to partition discharge spaces (i.e., discharge cells). Hence, a first discharge cell emitting red light, a second discharge cell emitting blue light, and a third discharge cell emitting green light, etc. may be formed between the front substrate 101 and the rear substrate 111.

The barrier rib 112 may include first and second barrier ribs 112*a* and 112*b* crossing each other. Heights of the first and second barrier ribs 112*a* and 112*b* may be different from each other. The first barrier rib 112*a* may be parallel to the scan electrode 102 and the sustain electrode 103, and the second barrier rib 112*b* may be parallel to the address electrode 113.

The height of the first barrier rib 112*a* may be less than the height of the second barrier rib 112*b*. Hence, in an exhaust process and a process for infecting a discharge gas, an impurity gas in the panel 100 may be efficiently exhausted to the outside of the panel 100, and the discharge gas may be uniformly injected. Each of the discharge cells partitioned by the barrier ribs 112 may be filled with the discharge gas.

A phosphor layer 114 may be formed inside the discharge cells to emit visible light for an image display during an address discharge. For example, first, second, and third phosphor layers that respectively generate red, blue, and green light may be formed inside the discharge cells.

FIG. 1 shows that the upper dielectric layer 104 and the lower dielectric layer 115 each have a single-layered structure. At least one of the upper dielectric layer 104 and the lower dielectric layer 115 may have a multi-layered structure.

While the address electrode 113 may have a substantially constant width or thickness, a width or thickness of the address electrode 113 inside the discharge cell may be different from a width or thickness of the address electrode 113 outside the discharge cell. For example, a width or thickness of the address electrode 113 inside the discharge cell may be greater than a width or thickness of the address electrode 113 outside the discharge cell.

An auxiliary electrode 106 may be positioned on the front substrate 101 parallel to the scan electrode 102 and the sustain electrode 103.

As shown in FIG. 2, first and second black layers 107 and 108 may be positioned on the front substrate 101 parallel to the scan electrode 102 and the sustain electrode 103. The auxiliary electrode 106 may be positioned on the second black layer 108.

The auxiliary electrode 106 may prevent charges from moving between the adjacent discharge cells to contribute to a prevention of crosstalk. The auxiliary electrode 106 may be formed of a material with excellent electrical conductivity, for example, silver (Ag), gold (Au), copper (Cu), aluminum (Al).

The upper dielectric layer 104 may be positioned on the second black layer 108 on which the auxiliary electrode 106 is positioned, the first black layer 107, the scan electrode 102, and the sustain electrode 103. The scan electrode 102 and the sustain electrode 103 may include transparent electrodes 102*a* and 103*a* and bus electrodes 102*b* and 103*b*.

The transparent electrodes 102*a* and 103*a* may be formed of a transparent material, for example, indium-tin-oxide (ITO). The bus electrodes 102*b* and 103*b* may be formed of a material with electrical conductivity, such as Ag to improve electrical conductivity of the scan and sustain electrodes 102 and 103. The bus electrodes 102*b* and 103*b* may be formed of the same material as the auxiliary electrode 106.

A third black layer 200 may be positioned between the transparent electrode 102*a* and the bus electrode 102*b* of the scan electrode 102, and a fourth black layer 210 may be positioned between the transparent electrode 103*a* and the bus electrode 103*b* of the sustain electrode 103.

When the first, second, third, and fourth black layers 107, 108, 200, and 210 are positioned as above, a reflection of light coming from the outside may be prevented. Contrast characteristics of a displayed image may be improved.

It may be preferable that a width of the auxiliary electrode 106 may be less than or substantially equal to a width of the second black layer 108, so as to improve the contrast characteristics by preventing light from the outside from being reflected by the auxiliary electrode 106.

The auxiliary electrode 106 and the first and second black layers 107 and 108 may be simultaneously fired, so as to reduce time required in a manufacturing process and reduce the manufacturing cost. The auxiliary electrode 106, the first, second, third, and fourth black layers 107, 108, 200, and 210, and the bus electrodes 102*b* and 103*b* may be simultaneously fired.

Figure 3:
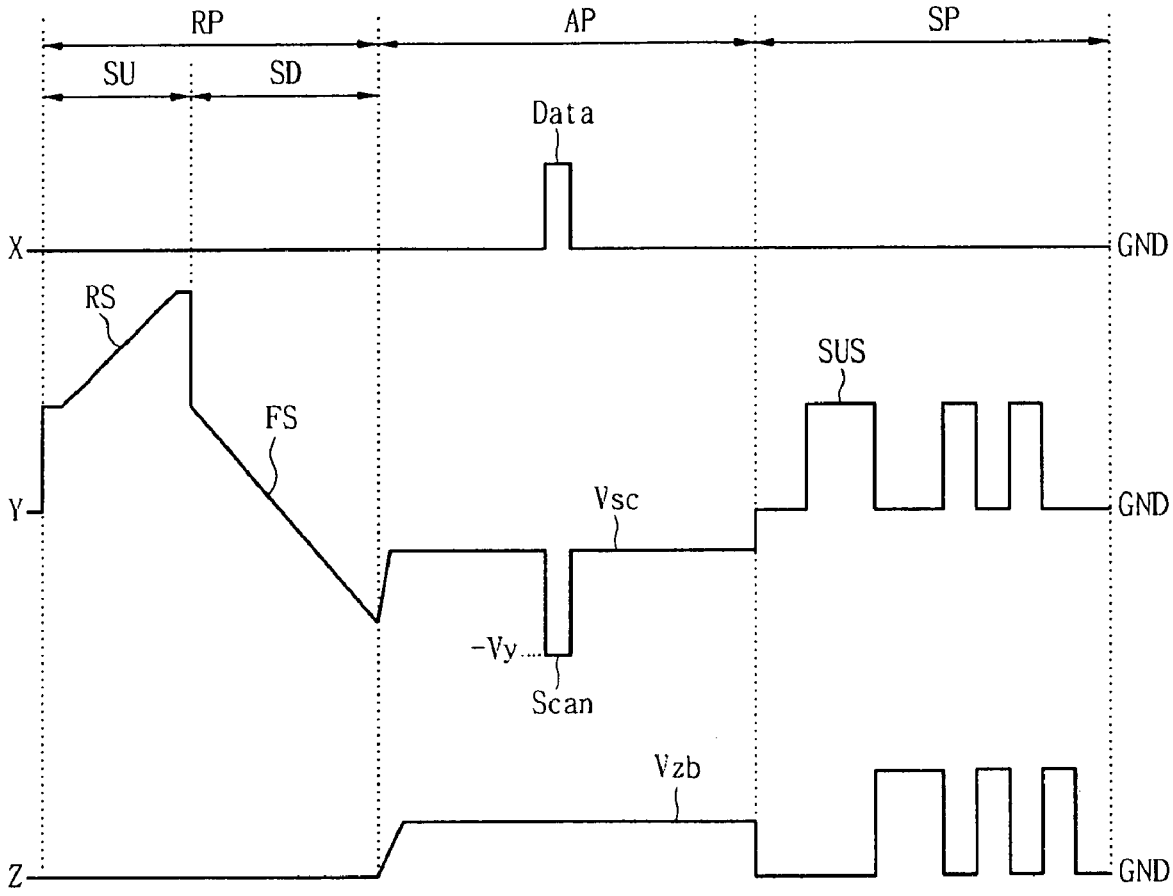
FIG. 3 illustrates an exemplary method of driving a plasma display panel.

FIG. 3 illustrates an exemplary method of driving the plasma display panel.

As shown in FIG. 3, a rising signal RS and a falling signal FS may be supplied to the scan electrode Y during a reset period RP for initialization of at least one subfield of a plurality of subfields of a frame.

More specifically, the rising signal RS may be supplied to the scan electrode Y during a setup period SU of the reset period RP, and the falling signal FS may be supplied to the scan electrode Y during a set-down period SD following the setup period SU. The rising signal RS may generate a weak dark discharge (i.e., a setup discharge) inside the discharge cells. Hence, the remaining wall charges may be uniformly distributed inside the discharge cells. The falling signal FS may generate a weak erase discharge (i.e., a set-down discharge) inside the discharge cells. Hence, the remaining wall charges may be uniformly distributed inside the discharge cells to the extent that an address discharge occurs stably.

During an address period AP following the reset period RP, a scan bias signal Vsc having a voltage greater than a minimum voltage of the falling signal FS may be supplied to the scan electrode Y. A scan signal Scan falling from the scan bias signal Vsc may be supplied to the scan electrode Y during the address period AP.

A pulse width of a scan signal supplied to the scan electrode during an address period of at least one subfield of a frame may be different from pulse widths of scan signals supplied during address periods of other subfields of the frame. A pulse width of a scan signal in a subfield may be greater than a pulse width of a scan signal in a next subfield. For example, a pulse width of the scan signal may be gradually reduced in the order of 2.6 μs, 2.3 μs, 2.1 μs, 1.9 μs, etc., or may be reduced in the order of 2.6 μs, 2.3 μs, 2.3 μs, 2.1 μs, . . . , 1.9 μs, 1.9 μs, etc. in the successively arranged subfields.

When the scan signal Scan is supplied to the scan electrode Y, a data signal Data corresponding to the scan signal Scan may be supplied to the address electrode X. As the voltage difference between the scan signal Scan and the data signal Data is added to a wall voltage by the wall charges produced during the reset period RP, an address discharge may occur inside the discharge cells to which the data signal Data is supplied.

During a sustain period SP following the address period AP, a sustain signal SUS may be supplied to at least one of the scan electrode Y or the sustain electrode Z. FIG. 3 shows that the sustain signals SUS are alternately supplied to the scan electrode Y and the sustain electrode Z. As the wall voltage inside the discharge cells selected by performing the address discharge is added to a sustain voltage of the sustain signal SUS, every time the sustain signal SUS is supplied, a sustain discharge (i.e., a display discharge) may occur between the scan electrode Y and the sustain electrode Z.

Figure 4:
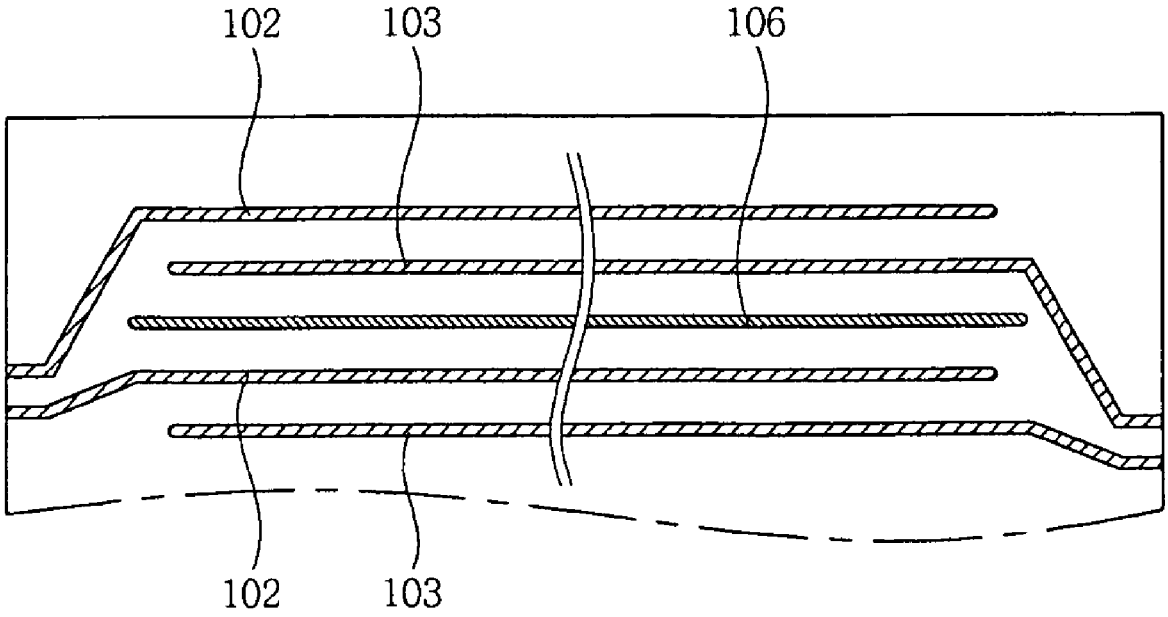
FIGS. 4 and 5 illustrate in detail an auxiliary electrode.
Figure 5:
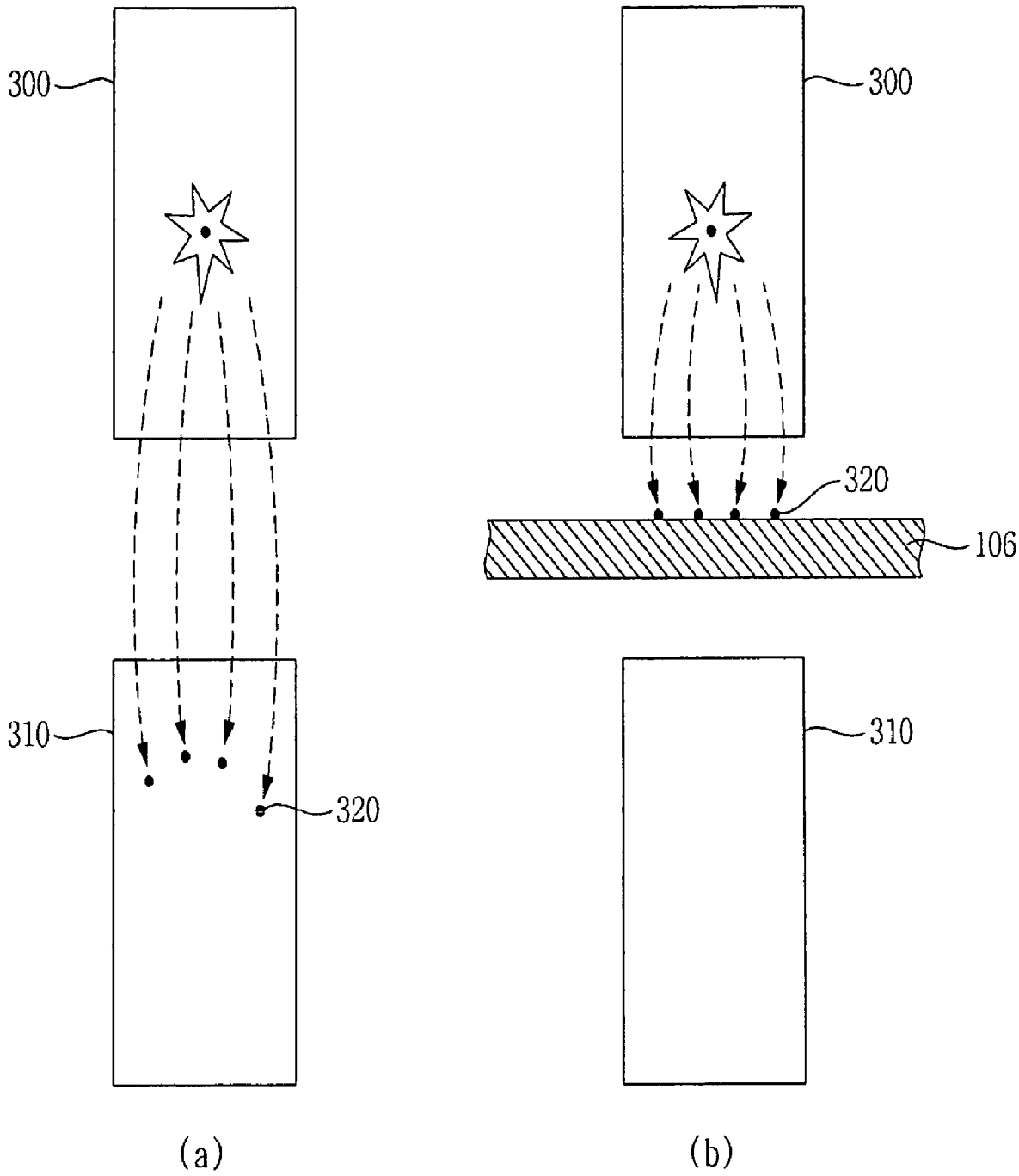

FIGS. 4 and 5 illustrate in detail the auxiliary electrode.

As shown in FIG. 4, both ends of the auxiliary electrode 106 may be positioned inside the panel. In other words, the auxiliary electrode 106 is not electrically connected to an external device and is in a floating state. In this case, a voltage may be produced in the auxiliary electrode 106 because of a coupling phenomenon resulting from a voltage of the scan electrode 102 or the sustain electrode 103 adjacent to the auxiliary electrode 106. Therefore, a voltage of the auxiliary electrode 106 may be determined by the voltage of the scan electrode or the sustain electrode 103 adjacent to the auxiliary electrode 106.

Unlike a description of FIG. 4, a predetermined voltage may be applied to the auxiliary electrode 106. For example, the auxiliary electrode 106 may include a pad portion (not shown) and may be connected to an external ground through the pad portion. Hence, the auxiliary electrode 106 may be held at a ground level voltage. Alternately, the auxiliary electrode 106 may be connected to an external driver through the pad portion and may be held at a positive voltage that is greater than the ground level voltage and less than the sustain voltage of the sustain signal SUS.

As above, the auxiliary electrode 106 may prevent charges from moving between the adjacent discharge cells to contribute to the prevention of crosstalk.

FIG. 5 shows an upper discharge cell 300 called as a first discharge cell and a lower discharge cell 310 called as a second discharge cell. It is assumed that the first discharge cell 300 is an on-cell in which a sustain discharge occurs and the second discharge cell 310 is an off-cell in which a sustain discharge does not occur.

If the auxiliary electrode is not formed as shown in (a) of FIG. 5, charges 320 resulting from the sustain discharge generated in the first discharge cell 300 may easily move to the second discharge cell 310 adjacent to the first discharge cell 300. Hence, the charges 320 may generate a sustain discharge in the second discharge cell 310 in which the sustain discharge does not have to occur. The image quality may be reduced because of the crosstalk phenomenon.

On the other hand, if the auxiliary electrode 106 is formed as shown in (b) of FIG. 5, the auxiliary electrode 106 may prevent charges 320 generated in the first discharge cell 300 from moving to the second discharge cell 310. Hence, the crosstalk phenomenon may be prevented.

It may be advantageous in an exhaust process and a process for injecting a discharge gas that the height of the first barrier rib 112*a* parallel to the scan electrode 102 and the sustain electrode 103 is less than the height of the second barrier rib 112*b* parallel to the address electrode 113. However, because charges easily move between the adjacent discharge cells, crosstalk may increase. Accordingly, when the height of the first barrier rib 112*a* is less than the height of the second barrier rib 112*b*, it may be preferable that the auxiliary electrode 106 is provided.

Figure 6:
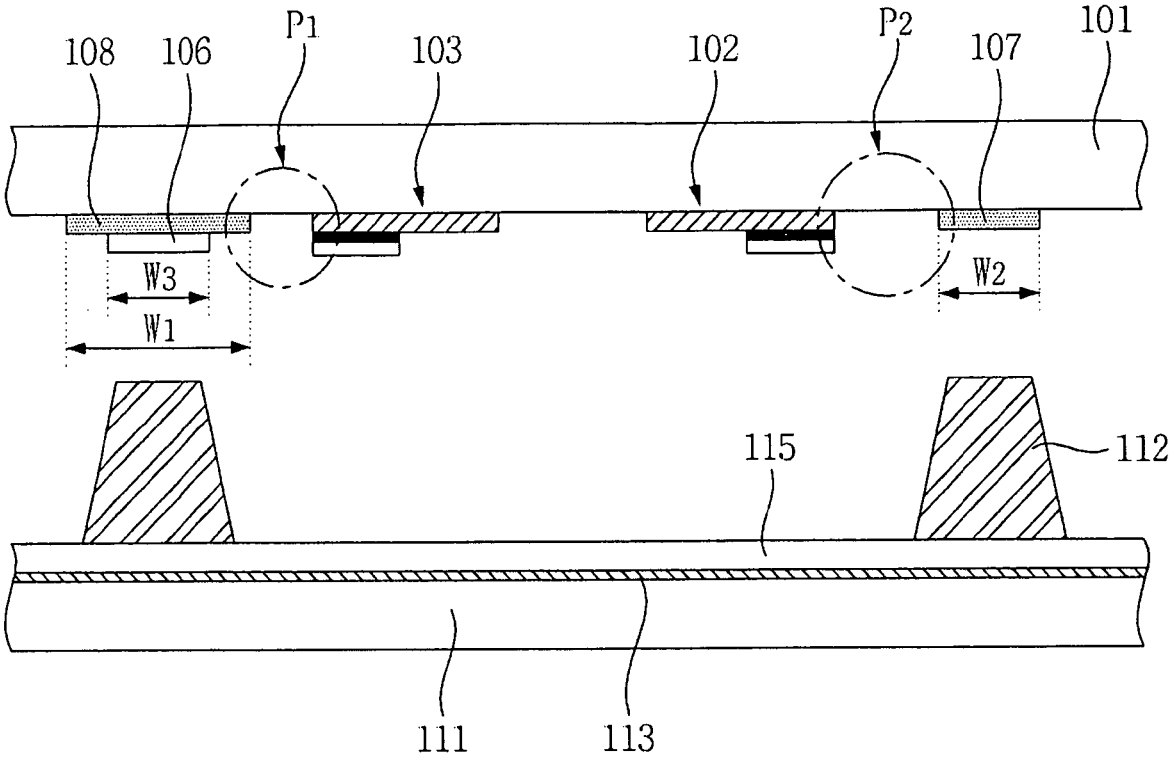
FIGS. 6 to 8 illustrate widths of first and second black layers.
Figure 7:
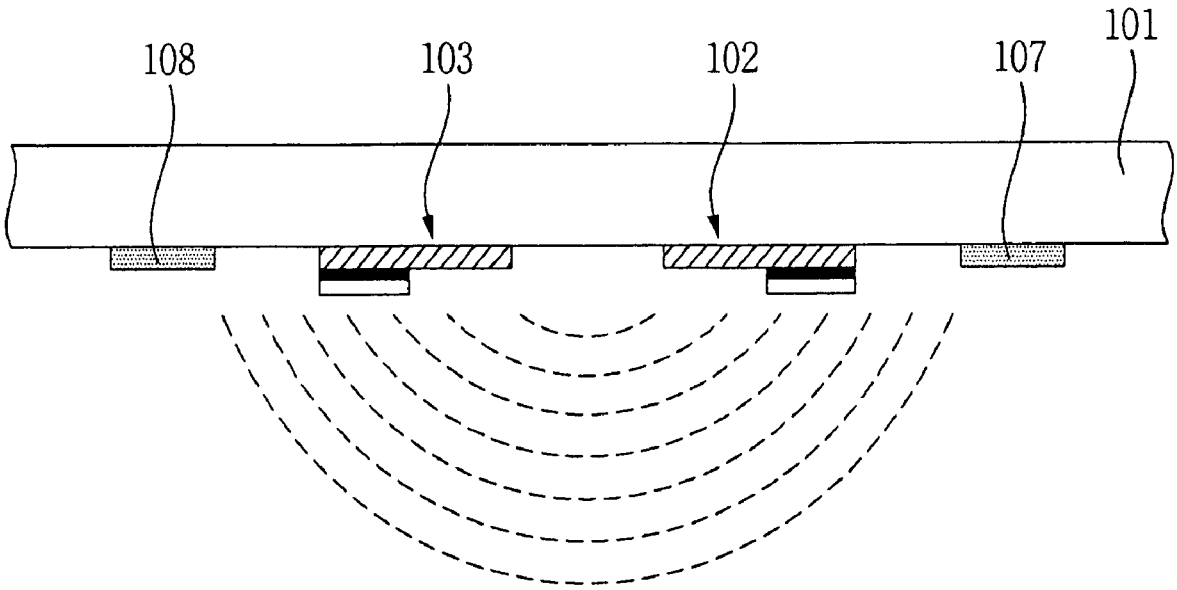
Figure 8:
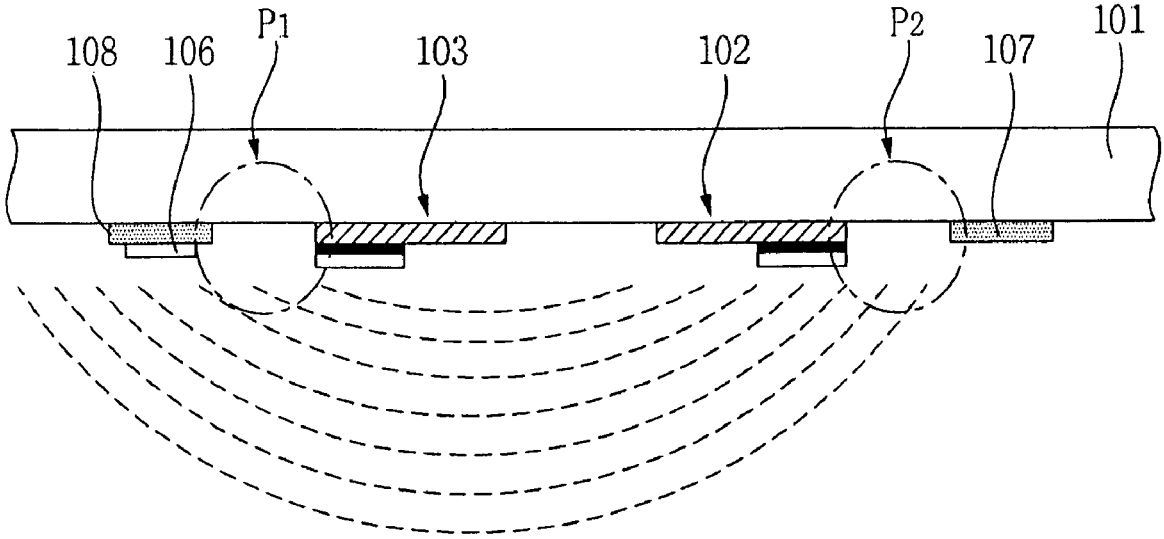

FIGS. 6 to 8 illustrate widths of first and second black layers.

As shown in FIG. 6, a width W1 of the second black layer 108 may be greater than a width W3 of the auxiliary electrode 106 on the second black layer 108. In this case, light coming from the outside of the panel may be prevented from being reflected by the auxiliary electrode 106, and thus the contrast characteristics may be improved.

Further, the width W1 of the second black layer 108 may be substantially equal to the width W3 of the auxiliary electrode 106. In this case, the contrast characteristics may be improved.

The widths W1, W2, and W3 of the second black layer 108, the first black layer 107, and the auxiliary electrode 106 are widths measured in a direction crossing the scan electrode 102 and the sustain electrode 103.

The width W1 of the second black layer 108 may be greater than the width W2 of the first black layer 107. This reason will be described with reference to FIGS. 7 and 8.

FIG. 7 shows the front substrate 101 in which the auxiliary electrode is omitted. In the front substrate 101 having the above-described structure, a sustain discharge starts to occur between the scan electrode 102 and the sustain electrode 103, and then the sustain discharge may be somewhat uniformly diffused. As a result, light may be somewhat uniformly generated inside the discharge cells.

On the other hand, FIG. 8 shows the front substrate 101 on which the auxiliary electrode 106 is formed. Because the auxiliary electrode 106 has electrical conductivity, a sustain discharge starting to occur between the scan electrode 102 and the sustain electrode 103 may be attracted to the auxiliary electrode 106. As a result, light may be non-uniformly generated inside the discharge cells.

As shown in FIG. 8, because the sustain discharge is attracted to the sustain electrode 103 because of the auxiliary electrode 106, an amount of light emitted to a portion P1 between the sustain electrode 103 and the auxiliary electrode 106 may be more than an amount of light emitted to a portion P2 between the scan electrode 102 and the auxiliary electrode 106. Hence, the image quality of the panel may worsen. For example, a viewer may perceive that a luminance sharply changes depending on a direction in which the viewer watches the screen of the panel. Further, the viewer may perceive that the luminance is excessively reduced in a specific direction. Consequently, the viewer may perceive that the image quality of the panel worsens because of the non-uniformity of light.

When the width W1 of the second black layer 108 on which the auxiliary electrode 106 is positioned is greater than the width W2 of the first black layer 107 on which the auxiliary electrode 106 is not positioned as shown in FIG. 6, an amount of light emitted to the portion P1 may be substantially equal to an amount of light emitted to the portion P2 even if the light is non-uniformly generated as shown in FIG. 8. Therefore, a reduction in the image quality may be prevented. It is preferable that the width W1 of the second black layer 108 is greater than the width W2 of the first black layer 107.

An amount of light may unnecessarily increase in a portion in which the auxiliary electrode 106 is positioned. As a result, the contrast characteristics may be reduced. However, light may be prevented from unnecessarily increasing in the portion in which the auxiliary electrode 106 is positioned by allowing the width W1 of the second black layer 108 overlapping the auxiliary electrode 106 to be greater than the width W2 of the first black layer 107. As a result, a reduction in the contrast characteristics may be prevented.

Figure 9:
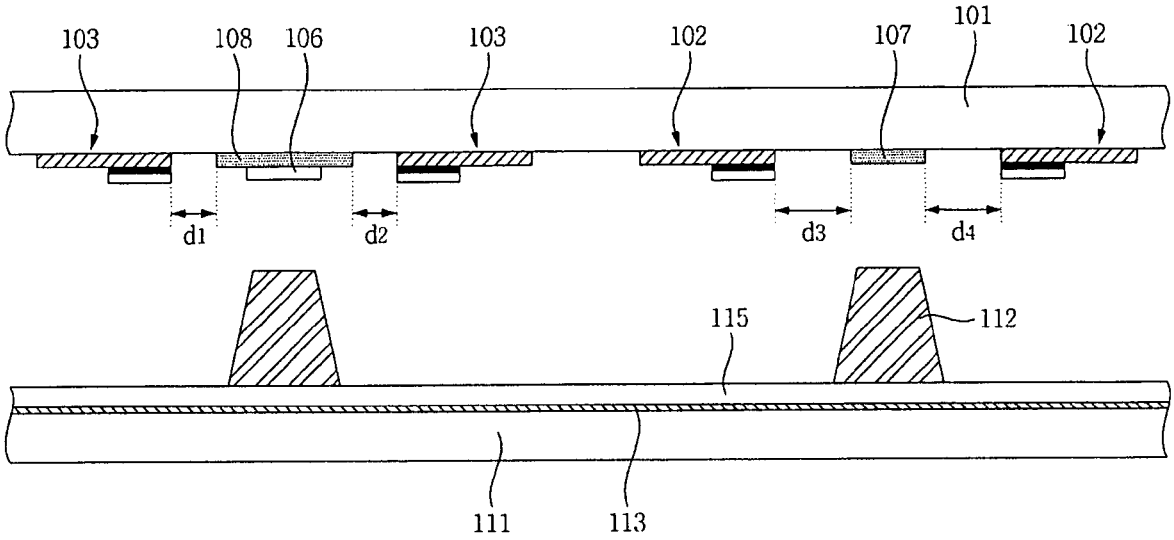
FIGS. 9 and 10 illustrate a location relationship between first and second black layers and scan and sustain electrodes.
Figure 10:
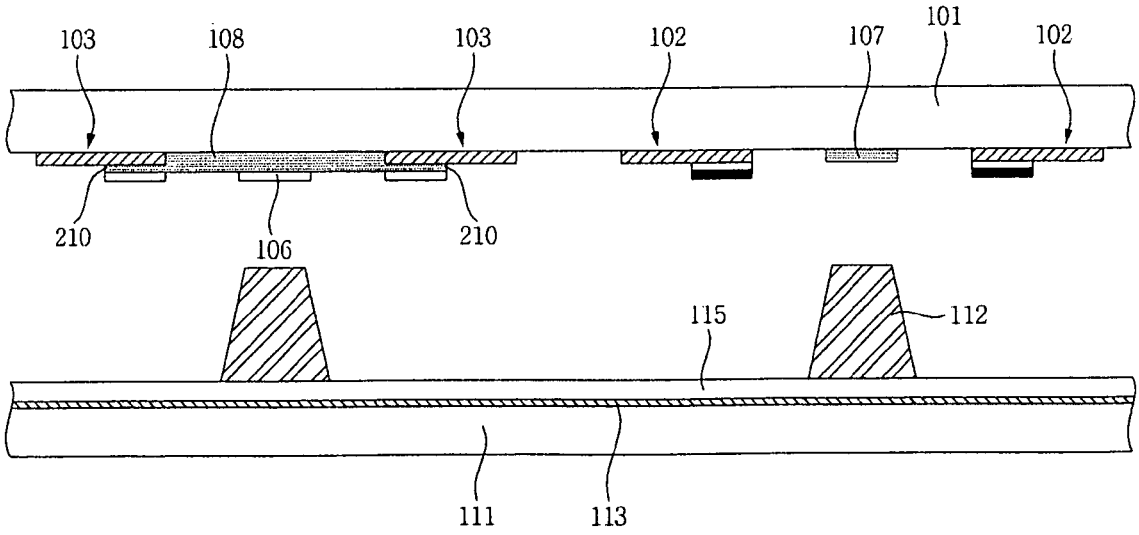

FIGS. 9 and 10 illustrate a location relationship between the first and second black layers and the scan and sustain electrodes.

As shown in FIG. 9, the first and second black layers 107 and 108 are positioned on the front substrate 101 parallel to each other with at least one scan electrode 102 and at least one sustain electrode 103 interposed between the first and second black layers 107 and 108.

The first and second black layers 107 and 108 may be spaced apart from the scan and sustain electrodes 102 and 103 adjacent to the first and second black layers 107 and 108. For example, FIG. 9 shows that the second black layer 108 is spaced apart from the two sustain electrodes 103 adjacent to the second black layer 108 at distances d1 and d2 and the first black layer 107 is spaced apart from the two scan electrodes 102 adjacent to the first black layer 107 at distances d3 and d4.

Because the width of the second black layer 108 is greater than the width of the first black layer 107, the distances d1 and d2 between the second black layer 108 and the sustain electrodes 103 may be shorter than the distances d3 and d4 between the first black layer 107 and the scan electrodes 102. The distances d1 and d2 may be substantially equal to or different from each other, and the distances d3 and d4 may be substantially equal to or different from each other.

The first black layer 107 may be spaced apart from the scan and sustain electrodes 102 and 103 adjacent to the first black layer 107, and the second black layer 108 may be poisoned to be connected to at least one scan electrode 102 or at least one sustain electrode 103 adjacent to the second black layer 108. For example, FIG. 10 shows the second black layer 108 connected to the two sustain electrodes 103 adjacent to the second black layer 108. In this case, the second black layer 108 and the fourth black layers 210 of the two sustain electrodes 103 may form one common black layer. In FIG. 10, the width of the second black layer 108 is greater than the width of the first black layer 107.

FIGS. 11 to 15 illustrate an arrangement structure of the scan electrode and the sustain electrode. The illustration of the first and second black layers is omitted in FIGS. 11 to 15.

Figure 11:
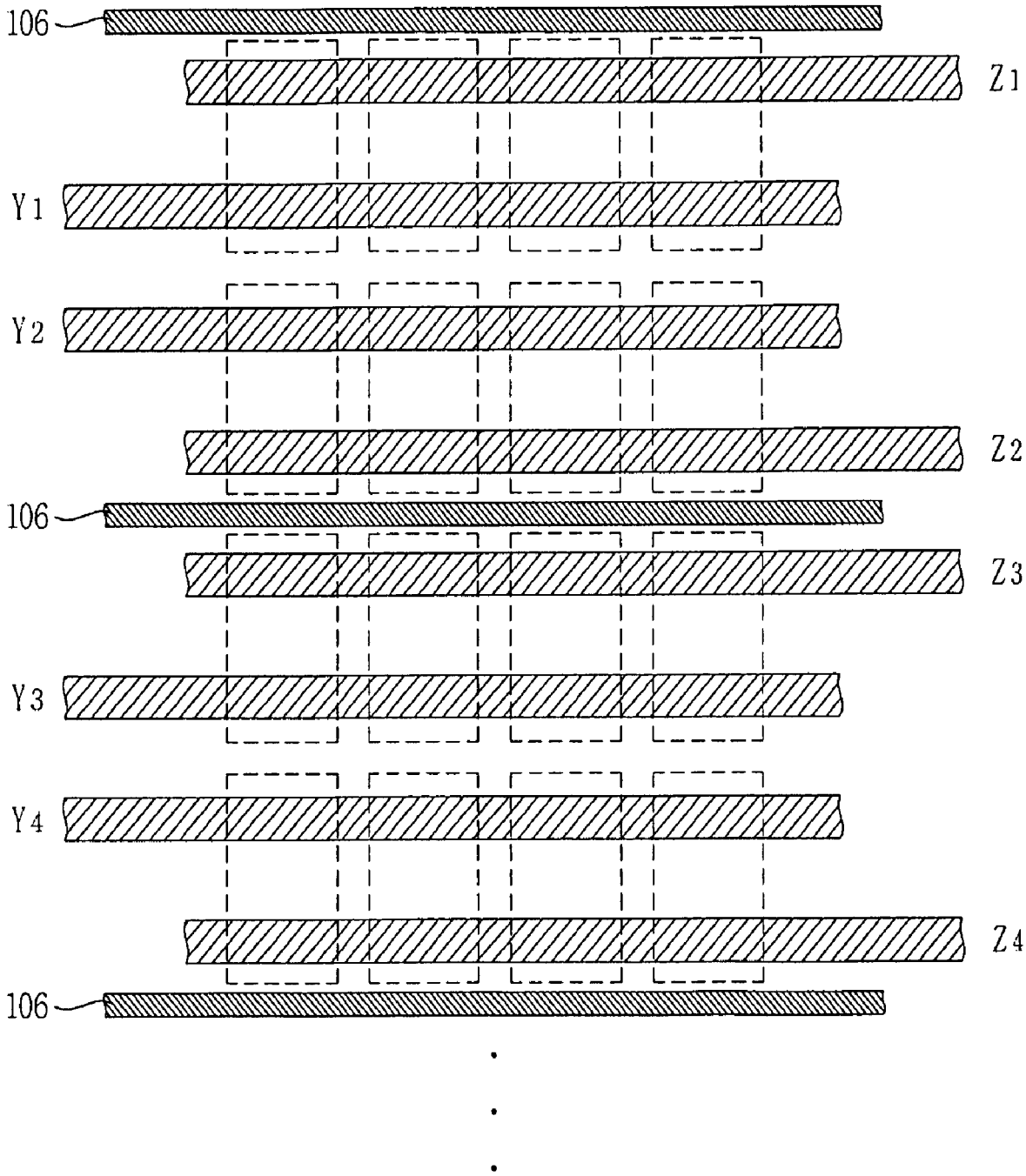
FIGS. 11 to 15 illustrate an arrangement structure of a scan electrode and a sustain electrode.

The two scan electrodes may be adjacently positioned, and the two sustain electrodes may be adjacently positioned. For example, FIG. 11 shows two adjacent scan electrodes Y1 and Y2, two adjacent scan electrodes Y3 and Y4, and two adjacent sustain electrodes Z2 and Z3.

In the above electrode arrangement, it may be preferable that the auxiliary electrode 106 is positioned between the two adjacent sustain electrodes. Namely, the second black layer is positioned between the two adjacent sustain electrodes, and the auxiliary electrode 106 is positioned on the second black layer.

In the above electrode arrangement, the drive efficiency may be improved by reducing a capacitance between the two adjacent scan electrodes and a capacitance between the two adjacent sustain electrodes. Further, the crosstalk may be reduced by reducing a voltage difference between the two adjacent scan electrodes and a voltage difference between the two adjacent sustain electrodes during a discharge.

Figure 12:
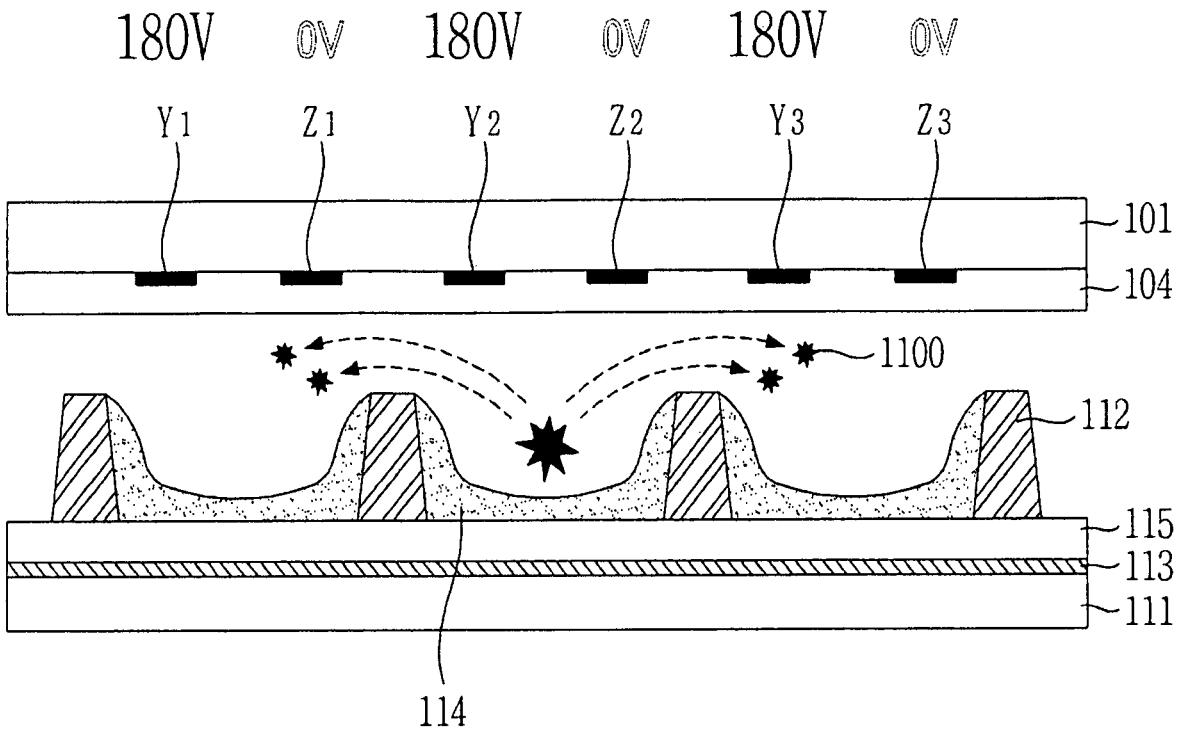

FIG. 12 shows that the scan electrodes Y1, Y2, and Y3 and the sustain electrodes Z1, Z2, and Z3 are alternately positioned. In FIG. 12, it is assumed that sustain signals having a voltage of 180V are supplied to the scan electrodes Y1, Y2, and Y3 and 0V is supplied to the sustain electrodes Z1, Z2, and Z3.

In this case, a movement of charges 1100 between the adjacent discharge cells may briskly occurs. For example, if a sustain discharge occurs between the scan electrode Y2 and the sustain electrode Z2 as shown in FIG. 12, a voltage difference of 180V is caused between the sustain electrode Z2 and the scan electrode Y3 and between the scan electrode Y2 and the sustain electrode Z1. The charges 1100 resulting from the sustain discharge generated between the scan electrode Y2 and the sustain electrode Z2 are attracted to the scan electrode Y3 or the sustain electrode Z1 and move to the discharge cell adjacent to the discharge cell where the sustain discharge occurs. As a result, a sustain discharge may occur between the scan electrode Y1 and the sustain electrode Z1 or between the scan electrode Y3 and the sustain electrode Z3. Namely, the crosstalk phenomenon may frequently occur.

Figure 13:
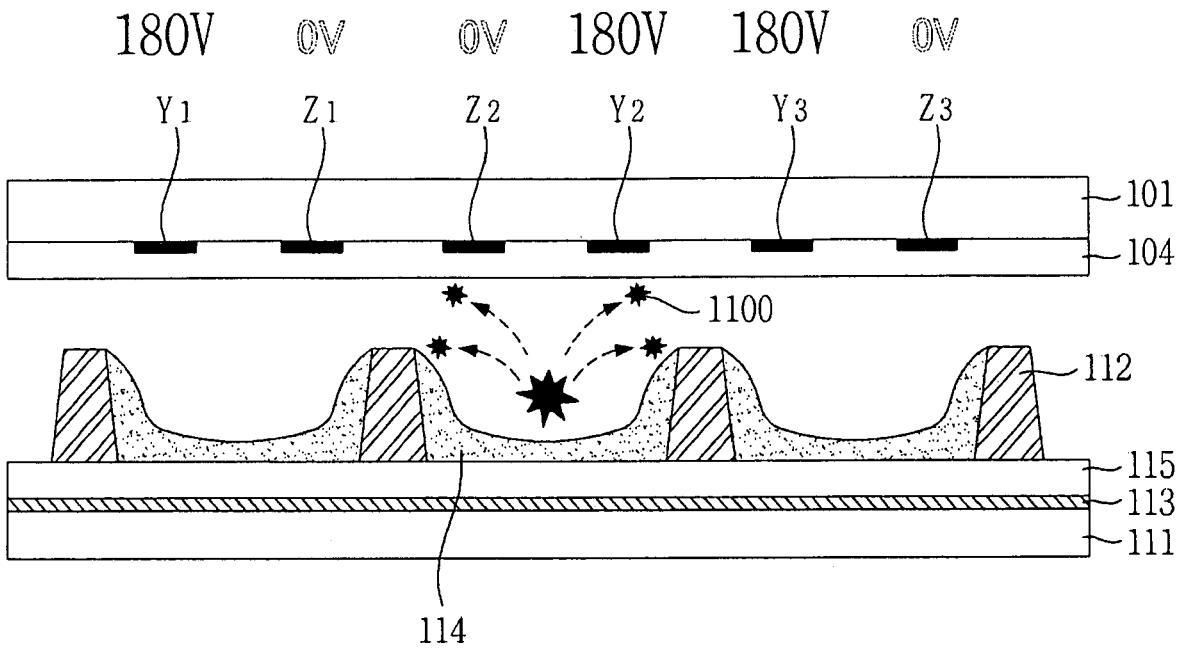

On the other hand, as shown in FIG. 13, when two scan electrodes are adjacently positioned and two sustain electrodes are adjacently positioned, a voltage difference of 0V is caused between the sustain electrodes Z1 and Z2 and the scan electrodes Y2 and Y3 even if sustain signals having a voltage of 180V are supplied to the scan electrodes and 0V is supplied to the sustain electrodes. Because a voltage difference is not caused between the adjacent discharge cells, a movement of charges 1100 is suppressed. Hence, the crosstalk may be reduced.

A reason why the auxiliary electrode 106 is positioned between the two adjacent sustain electrodes will be described with reference to FIGS. 14 and 15.

Figure 14:
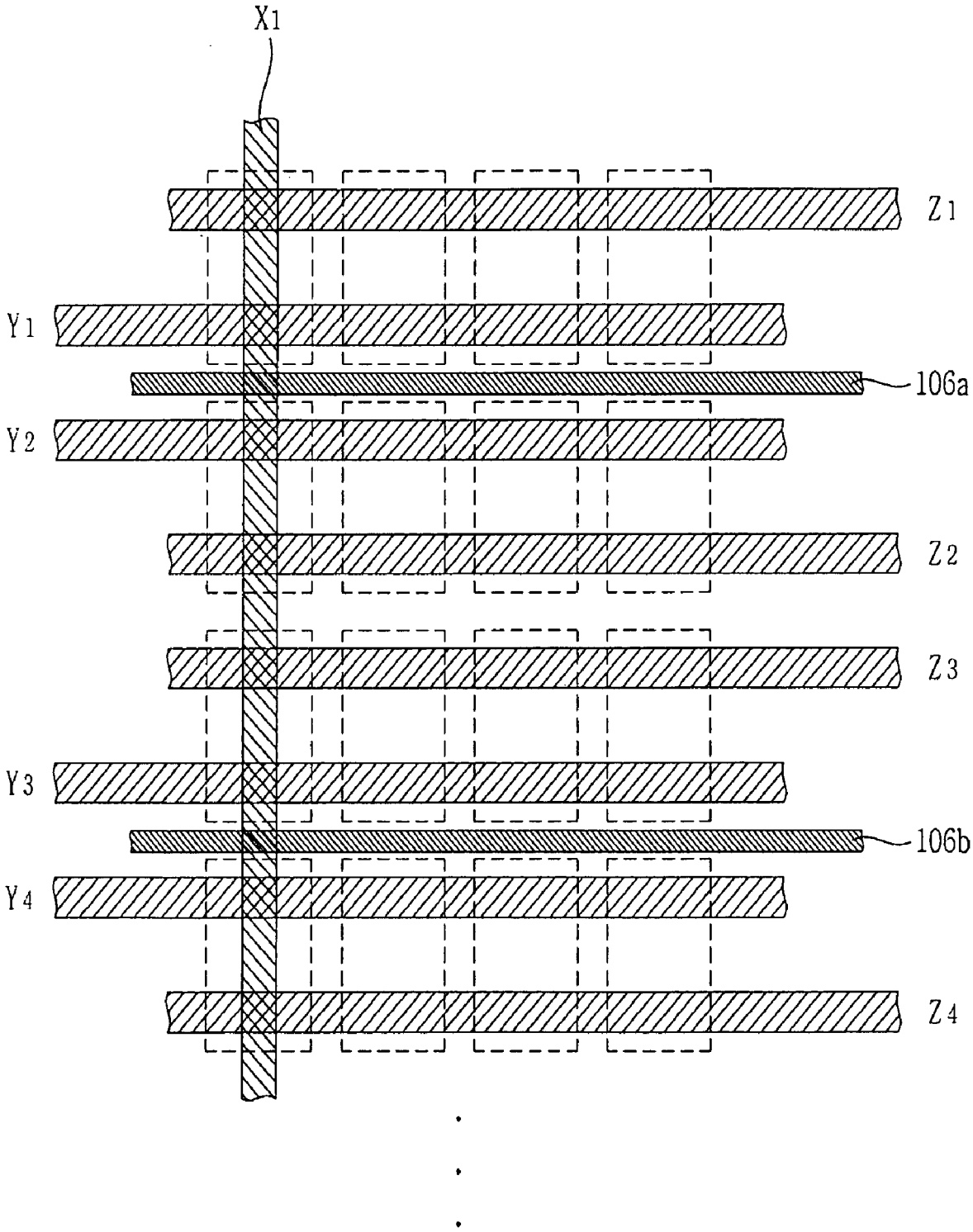

FIG. 14 shows the auxiliary electrode between the two adjacent scan electrodes. More specifically, a first auxiliary electrode 106*a* is positioned between the two scan electrodes Y1 and Y2, and a second auxiliary electrode 106*b* is positioned between the two scan electrodes Y3 and Y4.

Figure 15:
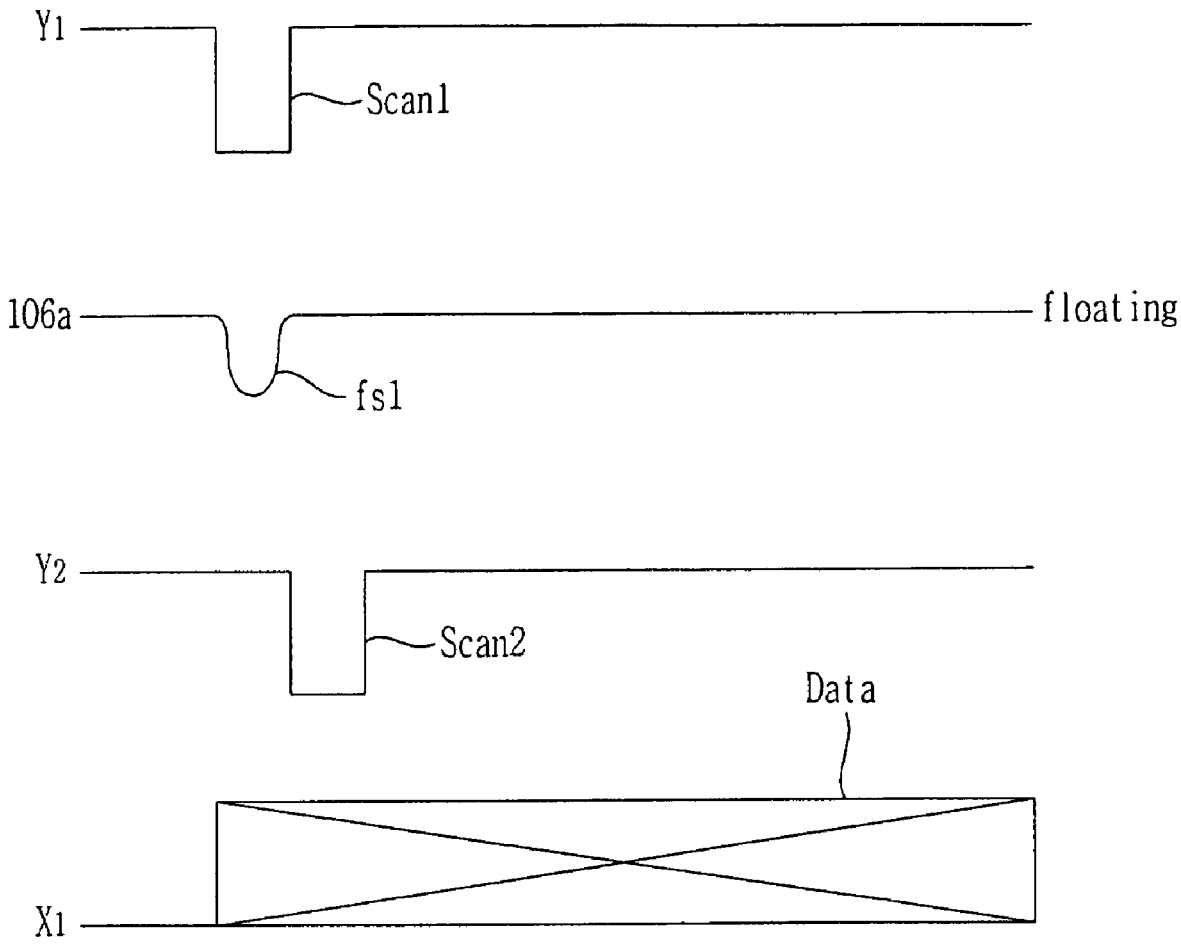

FIG. 15 illustrates an exemplary operation of the panel during an address period in the electrode structure shown in FIG. 14. The first and second auxiliary electrodes 106*a* and 106*b* are considered to be floated.

For example, when a first scan signal Scan1 is supplied to the scan electrode Y1, an address discharge may occur by a voltage difference between a data signal supplied to the address electrode X1 and the first scan signal Scan1. Further, when a second scan signal Scan2 is supplied to the scan electrode Y2, an address discharge may occur by a voltage difference between the data signal supplied to the address electrode X1 and the second scan signal Scan2.

When the address discharge occurs by the first scan signal Scan1 and the data signal, a first falling signal fs1 may be produced in the first auxiliary electrode 106*a* by a voltage of the first scan signal Scan1. A voltage of the first falling signal fs1 affects the scan electrode Y2 adjacent to the first auxiliary electrode 106*a*, and thus a distribution state of wall charges on the scan electrode Y2 may be non-uniform. Hence, the address discharge generated by the second scan signal Scan2 and the data signal may be unstable. Even if the voltage of the first falling signal fs1 has a excessively great value, an erroneous discharge may occur between the scan electrode Y2 or the first auxiliary electrode 106*a* and the address electrode when the address discharge occurs by the first scan signal Scan1 and the data signal.

As above, when the auxiliary electrode is positioned between two scan electrodes, the address discharge may unstably occur or the erroneous discharge may occur. Therefore, it is preferable that the auxiliary electrode is positioned between two sustain electrodes as shown in FIG. 11.

Figure 16:
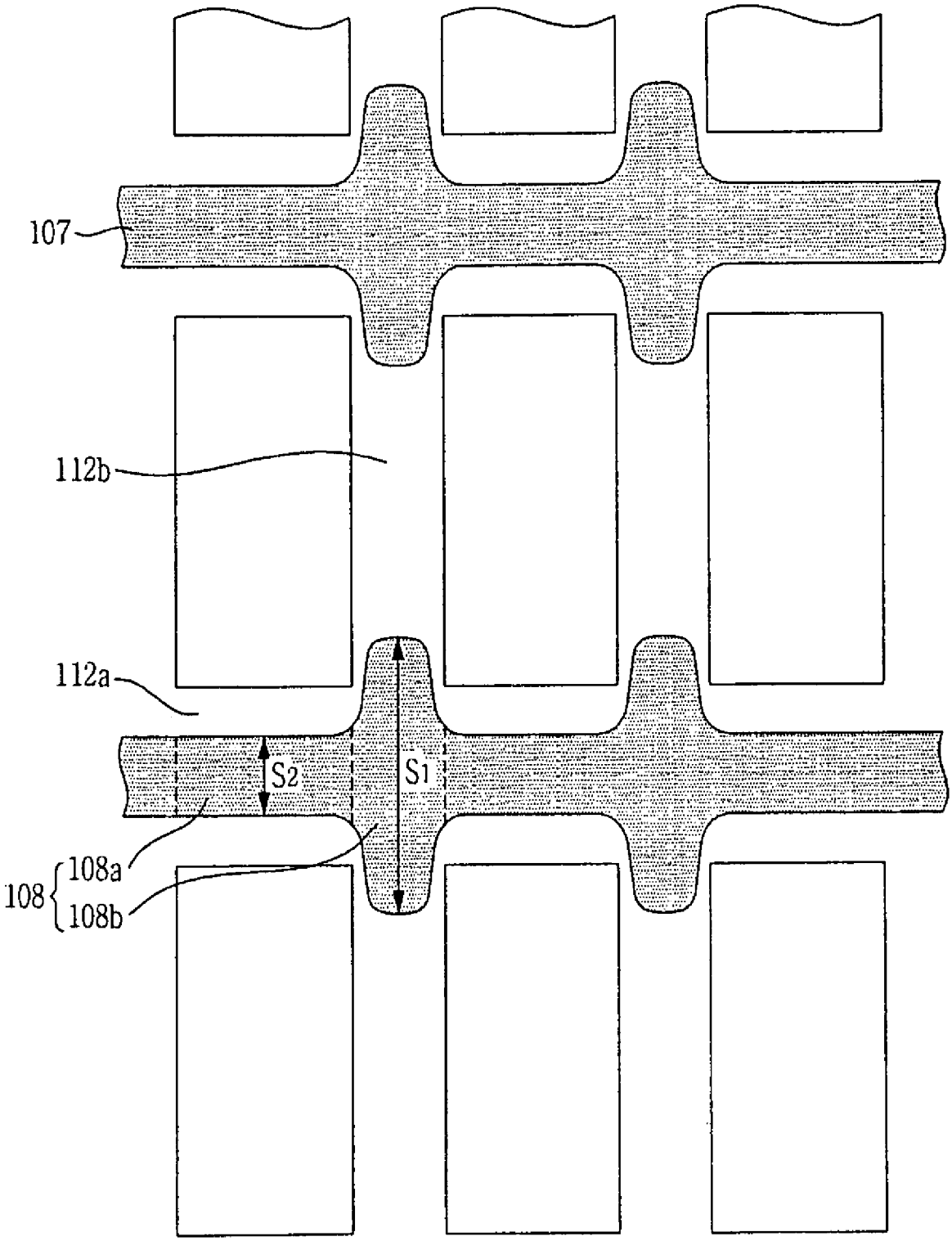
FIG. 16 illustrates structures of first and second black layers.

FIG. 16 illustrates structures of the first and second black layers.

At least one of the first and second black layers 107 and 108 may include first and second portions each having a different width. For example, FIG. 16 shows that the first and second black layers 107 and 108 each include a first portion having a first width S1 and a second portion having a first width S2.

Because the second black layer 108 includes the first portion 108*a* and the second portion 108*b* as shown in FIG. 16, the auxiliary electrode (not shown) on the second black layer 108 may include first and second portions each having a different width.

The second portions of the first and second black layers 107 and 108 may be positioned at a crossing of the first and second barrier ribs 112*a* and 112*b*.

As above, when at least one of the first and second black layers 107 and 108 includes the first and second portions, a black area may increase. Hence, the contrast characteristics may be improved. Further, when the second portion of the auxiliary electrode is positioned at the crossing of the first and second barrier ribs 112*a* and 112*b*, a black area may increase while a reduction in an aperture ratio is prevented. Hence, the contrast characteristics may be further improved.

Figure 17:
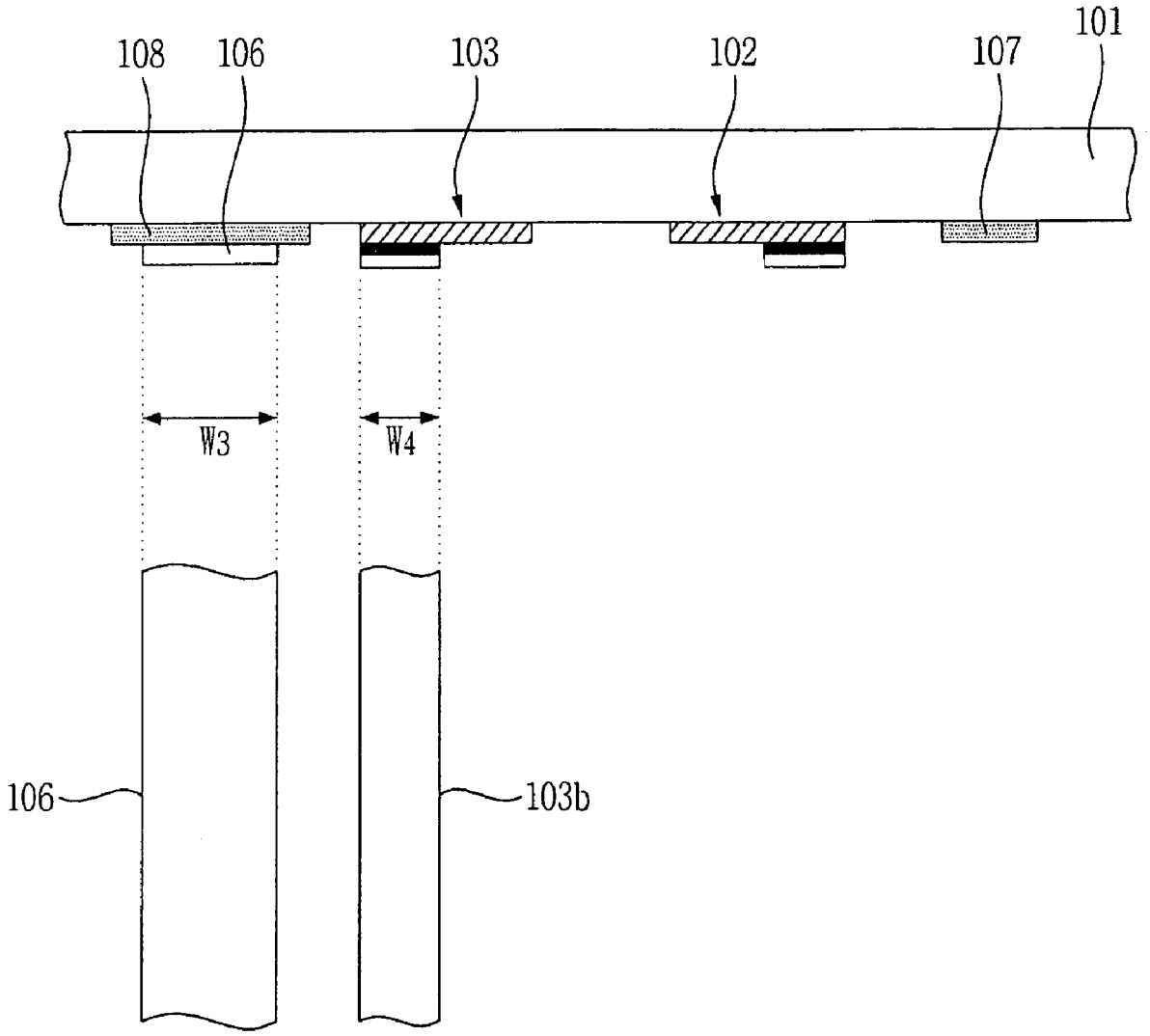
FIG. 17 illustrates widths of an auxiliary electrode and a bus electrode.

FIG. 17 illustrates widths of the auxiliary electrode and the bus electrode.

As shown in FIG. 17, a width W3 of the auxiliary electrode 106 may be greater than a width W4 of the bus electrode 103*b*. The width W3 of the auxiliary electrode 106 may be greater than a width of the bus electrode of the scan electrode 102 as well as the bus electrode 103*b* of the sustain electrode 103.

As above, when the width W3 of the auxiliary electrode 106 is greater than the width W4 of the bus electrode 103*b*, a charge capacity of the auxiliary electrode 106 may sufficiently increase. Therefore, charge may be prevented from moving between the adjacent discharge cells, and the crosstalk may be reduced.

Figure 18:
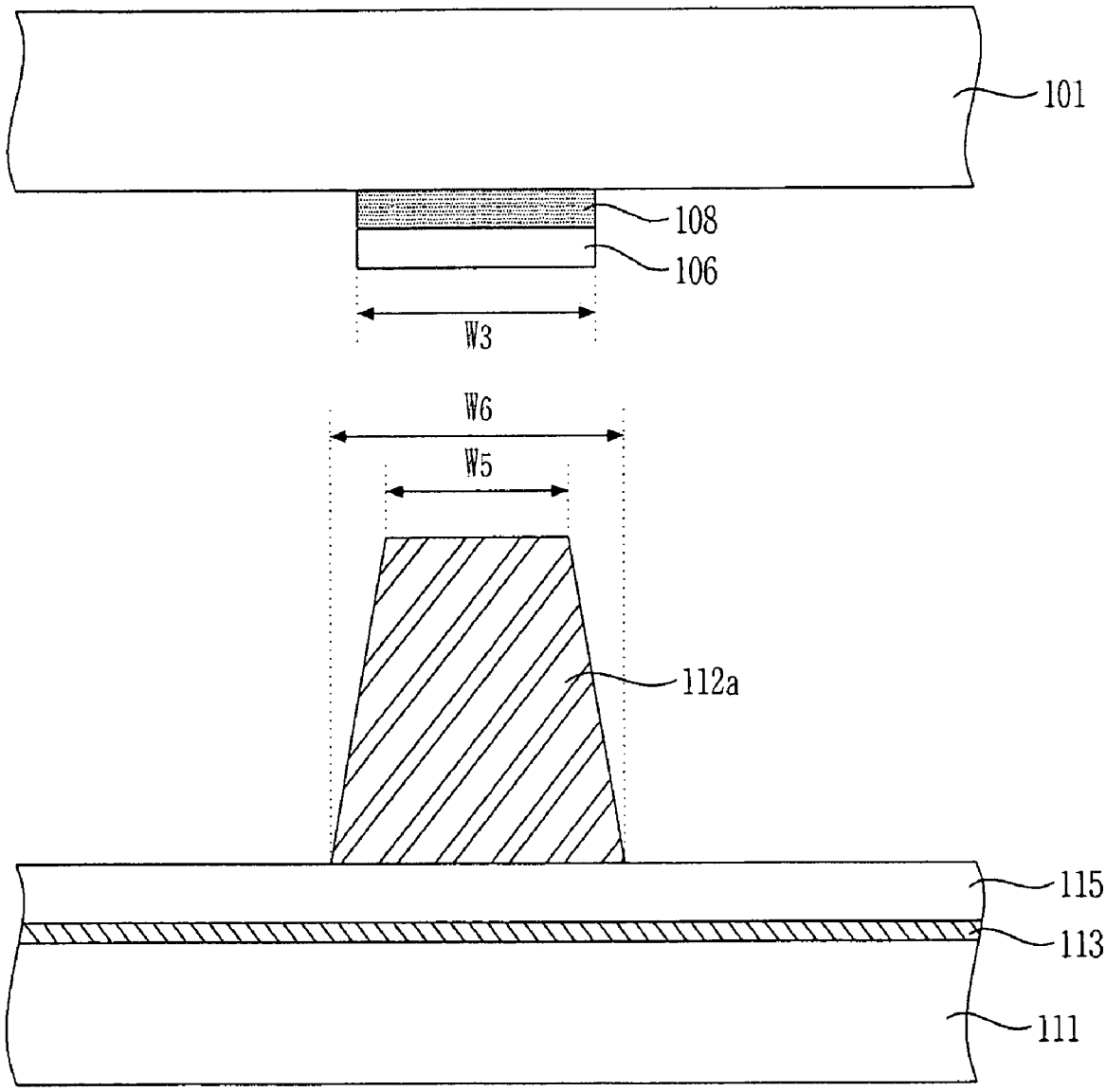
FIGS. 18 to 20 illustrate an auxiliary electrode and a barrier rib.
Figure 19:
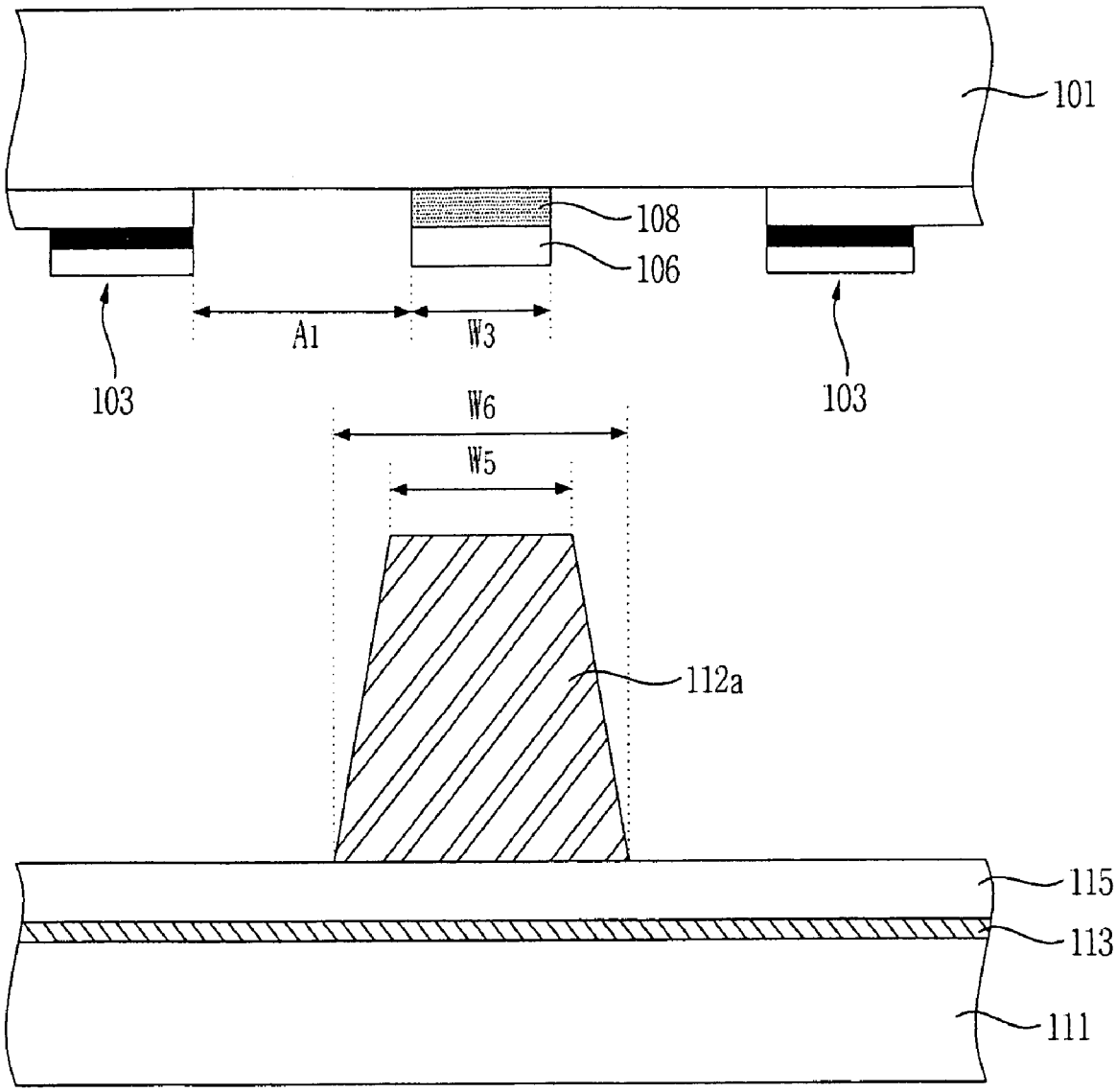
Figure 20:
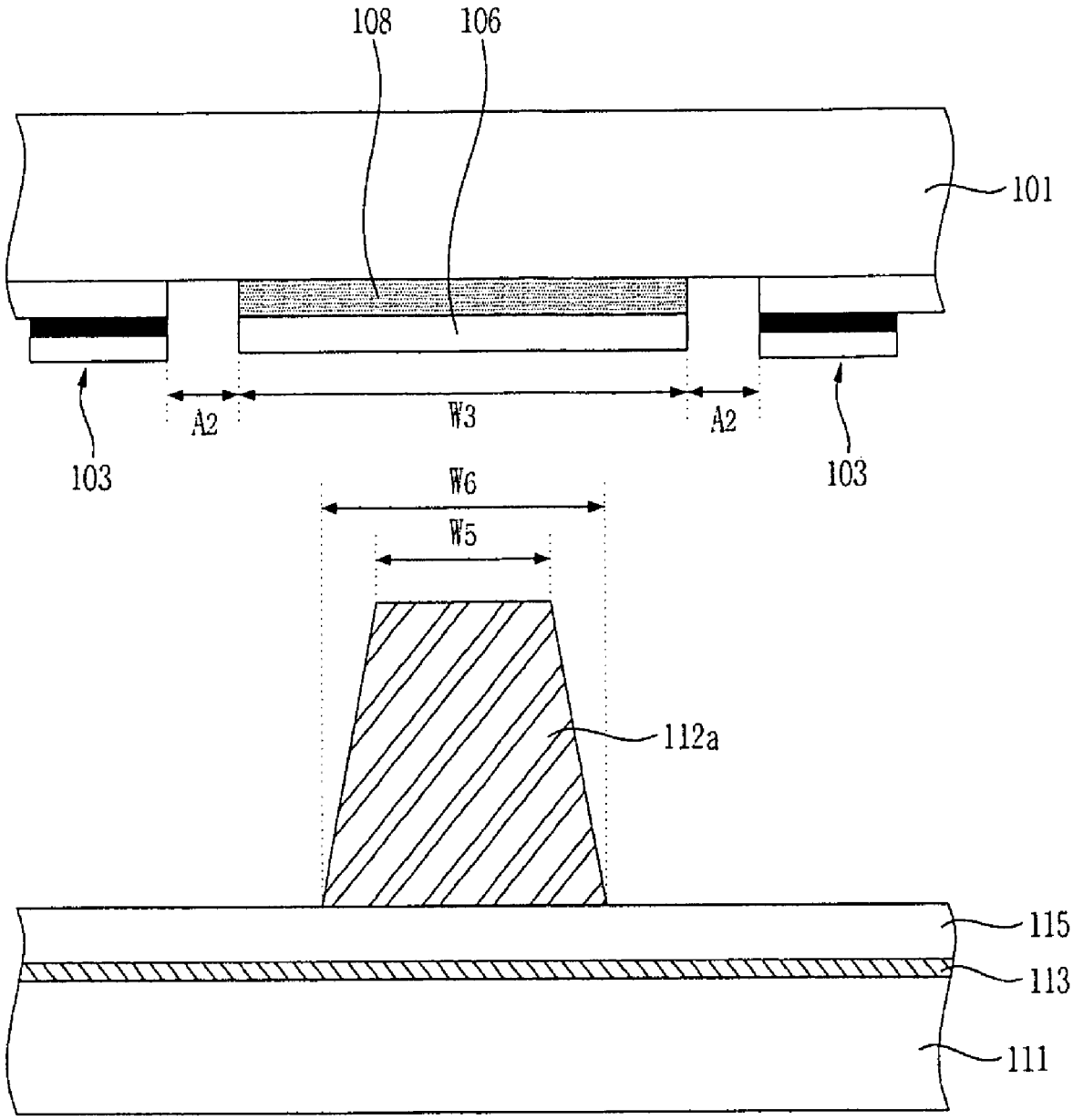

FIGS. 18 to 20 illustrate the auxiliary electrode and the barrier rib.

As shown in FIG. 18, the width W3 of the auxiliary electrode 106 may be greater than an upper width W5 of the first barrier rib 112*a* and less than a lower width W6 of the first barrier rib 112*a*. Further, the width W3 of the auxiliary electrode 106 may be substantially equal to the upper width W5 or the lower width W6 of the first barrier rib 112*a*.

When the width W3 of the auxiliary electrode 106 is equal to or greater than the upper width W5 of the first barrier rib 112*a* and is equal to or less than the lower width W6 of the first barrier rib 112*a*, electrical short circuit between the auxiliary electrode 106 and the scan electrode 102 or the sustain electrode 103 adjacent to the auxiliary electrode 106 may be prevented while charge are prevented from moving between the adjacent discharge cells.

As shown in FIG. 19, when the width W3 of the auxiliary electrode 106 is less than the upper width W5 of the first barrier rib 112*a*, the charge capacity of the auxiliary electrode 106 may be reduced because of the narrow auxiliary electrode 106. Hence, it may be difficult to prevent the crosstalk. Further, a distance A1 between the auxiliary electrode 106 and the scan electrode 102 or the sustain electrode 103 adjacent to the auxiliary electrode 106 may excessively increase. Hence, an amount of light reflected by the first barrier rib 112*a* may increase, and the contrast characteristics may be reduced.

As shown in FIG. 20, when the width W3 of the auxiliary electrode 106 is greater than the lower width W6 of the first barrier rib 112*a*, a distance A2 between the auxiliary electrode 106 and the scan electrode 102 or the sustain electrode 103 adjacent to the auxiliary electrode 106 may excessively decrease because of the wide auxiliary electrode 106. In this case, electrical short circuit may occur between the auxiliary electrode 106 and the scan electrode 102 or the sustain electrode 103 adjacent to the auxiliary electrode 106, thereby unstably generating a discharge.

Considering this, it may be preferable that the width W3 of the auxiliary electrode 106 is equal to or greater than the upper width W5 of the first barrier rib 112*a* and is equal to or less than the lower width W6 of the first barrier rib 112*a*.

Figure 21:
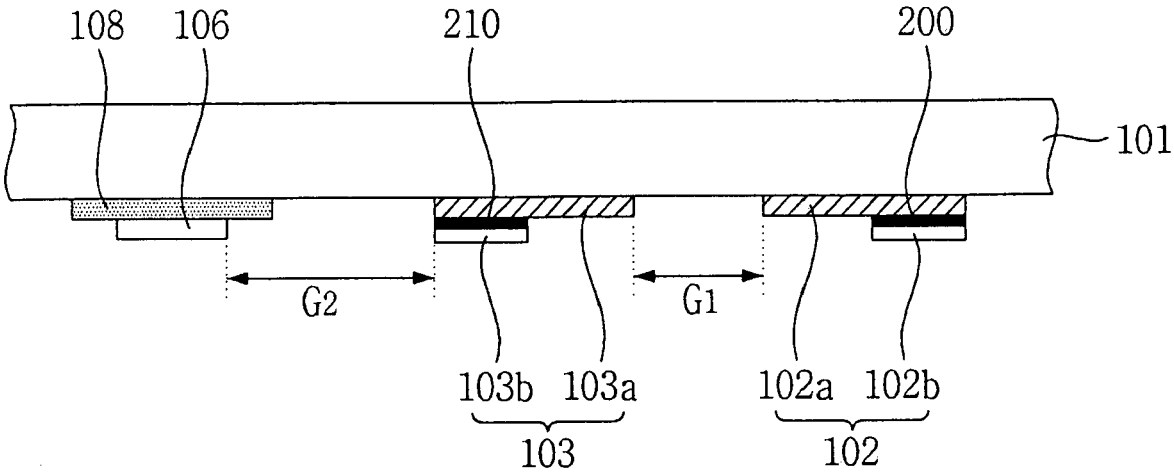
FIG. 21 illustrates a distance between an auxiliary electrode and a scan electrode or a sustain electrode.

FIG. 21 illustrates the scan electrode, the sustain electrode, and the auxiliary electrode.

As shown in FIG. 21, a distance G2 between the auxiliary electrode 106 and the scan electrode 102 or the sustain electrode 103 may be greater than a distance G1 between the scan electrode 102 and the sustain electrode 103. In this case, a firing voltage between the scan electrode 102 and the sustain electrode 103 may be prevented from excessively rising, and a reduction in the drive efficiency may be prevented. Further, a discharge generated between the scan electrode 102 and the sustain electrode 103 may be prevented from being excessively attracted to the auxiliary electrode 106.

Figure 22A:
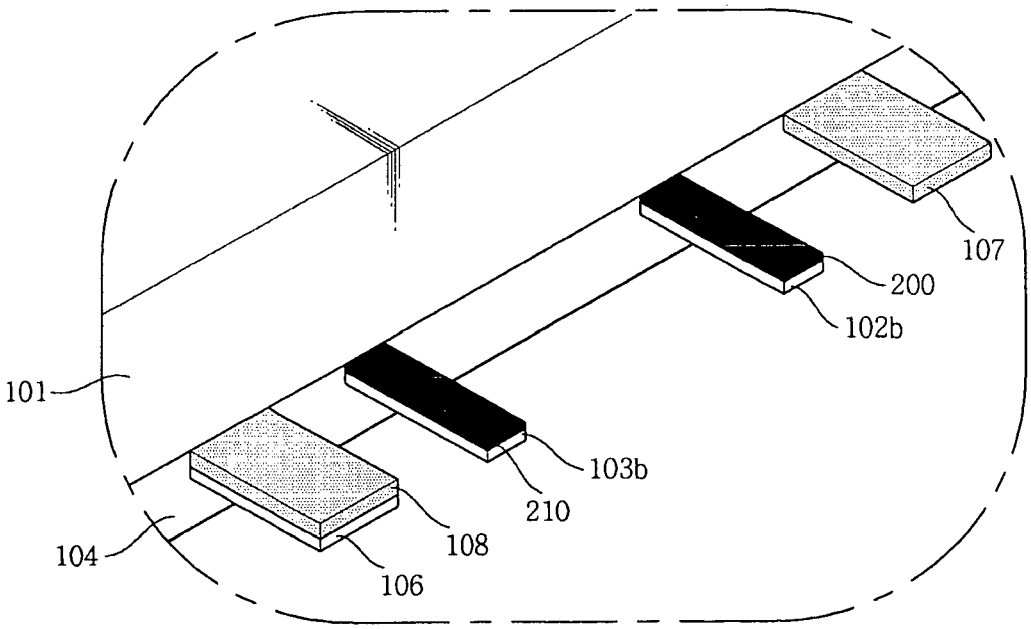
FIGS. 22A and 22B illustrate a structure of a plasma display panel when a scan electrode and a sustain electrode each include a bus electrode without a transparent electrode.
Figure 22B:
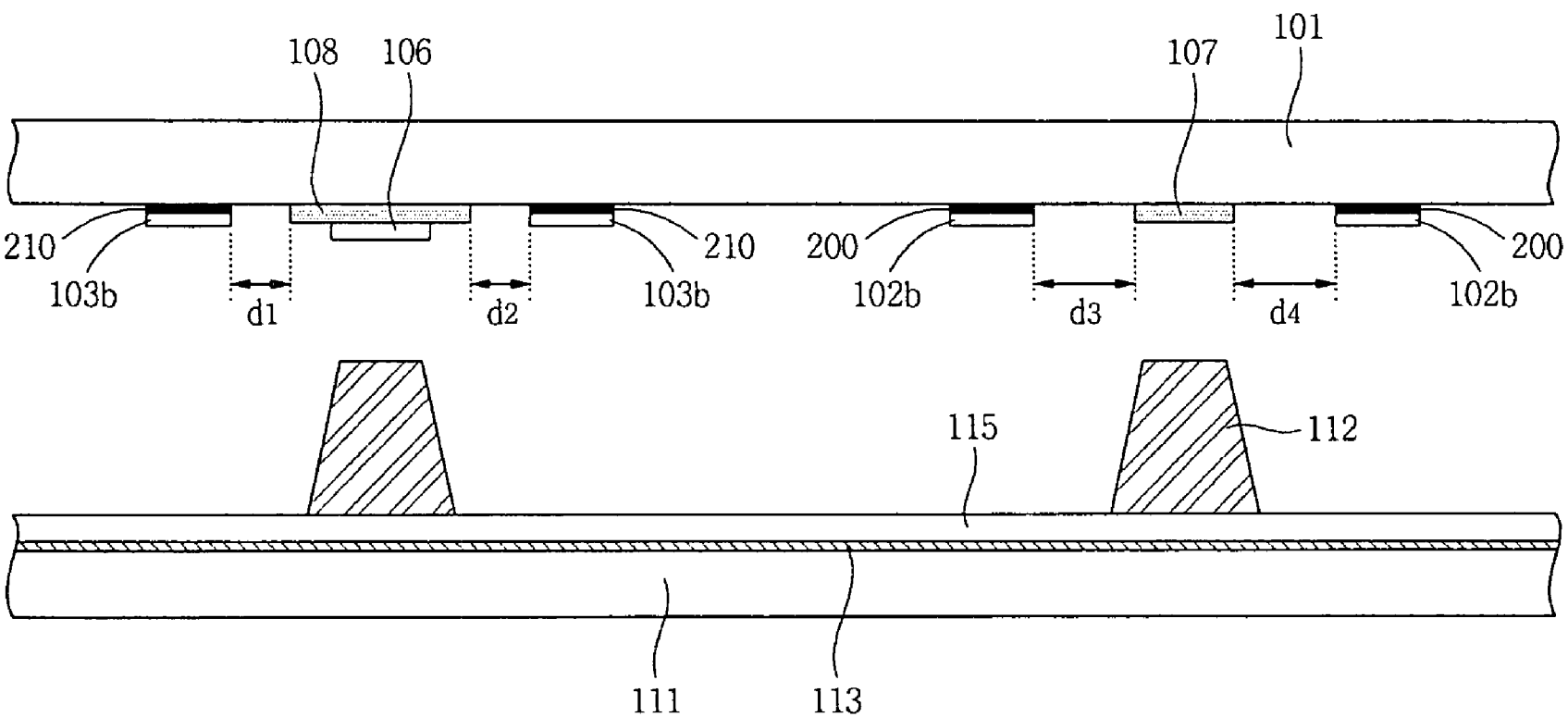

FIGS. 22A and 22B illustrate a structure of a plasma display panel when the scan electrode 102 and the sustain electrode 103 each include only the bus electrodes 102*b* and 103*b* without the transparent electrode.

As shown in FIG. 22A, each of the scan electrode 102 and the sustain electrode 103 may include the bus electrodes 102*b* and 103*b* without the transparent electrode.

The scan electrode 102 and the sustain electrode 103 including the bus electrodes 102*b* and 103*b* may be formed of a material with excellent electrical conductivity that is easy to mold, for example, silver (Ag), gold (Au), copper (Cu), aluminum (Al).

As shown in FIG. 22B, a width W1 of the second black layer 108 may be greater than a width W2 of the first black layer 107. This reason is the same as that described in FIGS. 7 and 8. The first black layer 107 is positioned between the two adjacent scan electrodes to be spaced apart from the two scan electrodes. The second black layer 108 is positioned between the two adjacent sustain electrodes to be spaced apart from the two sustain electrodes.

The above-described description may be applied to the plasma display panel illustrated in FIGS. 22A and 22B in which the transparent electrode is omitted.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A plasma display panel comprising:

a front substrate;

scan electrodes and sustain electrodes that are positioned on the front substrate substantially parallel to each other;

a rear substrate opposite the front substrate;

a barrier rib on the rear substrate;

a black layer opposite the barrier rib, the black layer being positioned on the front substrate substantially parallel to the scan electrode and the sustain electrode, the black layer including a first black layer between two adjacent scan electrodes and a second black layer between two adjacent sustain electrodes; and an auxiliary electrode on the second black layer.

2. The plasma display panel of claim 1, wherein a width of the second black layer is greater than a width of the first black layer.

3. The plasma display panel of claim 1, wherein the first black layer is spaced apart from the scan electrodes adjacent to the first black layer, and the second black layer is connected to at least one sustain electrode adjacent to the second black layer.

4. The plasma display panel of claim 1, wherein at least one of the first black layer and the second black layer includes a first portion having a first width and a second portion having a second width greater than the first width.

5. The plasma display panel of claim 4, wherein the barrier rib includes a first barrier rib substantially parallel to the scan electrode and the sustain electrode and a second barrier rib crossing the first barrier rib, wherein the second portion is positioned in a crossing of the first barrier rib and the second barrier rib.

6. The plasma display panel of claim 1, wherein a width of the auxiliary electrode is equal to or less than a width of the second black layer.

7. The plasma display panel of claim 1, wherein the scan electrode and the sustain electrode each include a transparent electrode and a bus electrode on the transparent electrode, wherein a width of the auxiliary electrode is equal to or greater than a width of the bus electrode.

8. The plasma display panel of claim 1, wherein a shortest distance between the auxiliary electrode and the sustain electrode is greater than a shortest distance between the scan electrode and the sustain electrode in a discharge cell.

9. The plasma display panel of claim 1, wherein the auxiliary electrode is floated.

10. The plasma display panel of claim 1, wherein the barrier rib includes a first barrier rib substantially parallel to the scan electrode and the sustain electrode and a second barrier rib crossing the first barrier rib, wherein a height of the first barrier rib is less than a height of the second barrier rib.

11. The plasma display panel of claim 1, wherein a shortest distance between the second black layer and the sustain electrode is shorter than a shortest distance between the first black layer and the scan electrode.

12. A plasma display panel comprising:

a front substrate;

scan electrodes and sustain electrodes that are positioned on the front substrate substantially parallel to each other;

a rear substrate opposite the front substrate;

a barrier rib on the rear substrate;

a black layer opposite the barrier rib, the black layer being positioned on the front substrate substantially parallel to the scan electrode and the sustain electrode, the black layer including a first black layer between two adjacent scan electrodes and a second black layer between two adjacent sustain electrodes, a width of the second black layer being greater than a width of the first black layer; and an auxiliary electrode on the second black layer.

13. The plasma display panel of claim 12, wherein the first black layer is spaced apart from the scan electrodes adjacent to the first black layer, and the second black layer is connected to at least one sustain electrode adjacent to the second black layer.

14. The plasma display panel of claim 12, wherein a shortest distance between the auxiliary electrode and the sustain electrode is greater than a shortest distance between the scan electrode and the sustain electrode in a discharge cell.

15. The plasma display panel of claim 12, wherein the auxiliary electrode is floated.

16. The plasma display panel of claim 12, wherein a shortest distance between the second black layer and the sustain electrode is shorter than a shortest distance between the first black layer and the scan electrode.

17. A plasma display panel comprising:

a front substrate;

scan electrodes and sustain electrodes that are positioned on the front substrate substantially parallel to each other, the scan electrodes and the sustain electrodes being bus electrodes;

a rear substrate opposite the front substrate;

a barrier rib on the rear substrate;

a black layer opposite the barrier rib, the black layer being positioned on the front substrate substantially parallel to the scan electrode and the sustain electrode, the black layer including a first black layer between two adjacent scan electrodes and a second black layer between two adjacent sustain electrodes, a width of the second black layer being greater than a width of the first black layer; and an auxiliary electrode on the second black layer.

18. The plasma display panel of claim 17, wherein the first black layer is spaced apart from the scan electrodes adjacent to the first black layer, and the second black layer is connected to at least one sustain electrode adjacent to the second black layer.

19. The plasma display panel of claim 17, wherein a shortest distance between the auxiliary electrode and the sustain electrode is greater than a shortest distance between the scan electrode and the sustain electrode in a discharge cell.

20. The plasma display panel of claim 17, wherein the auxiliary electrode is floated.

* * * * *